US007651083B2

(12) United States Patent
Embury et al.

(10) Patent No.: US 7,651,083 B2
(45) Date of Patent: Jan. 26, 2010

(54) CONVEYING APPARATUS AND METHOD

(75) Inventors: Glenn R. Embury, Fontana, CA (US); Philip G. Barboni, Upland, CA (US)

(73) Assignee: Digital Check Corporation, Northfield, IL (US)

( * ) Notice: Subject to any disclaimer, the term of this patent is extended or adjusted under 35 U.S.C. 154(b) by 116 days.

(21) Appl. No.: 11/534,007

(22) Filed: Sep. 21, 2006

(65) Prior Publication Data

US 2008/0073835 A1 Mar. 27, 2008

(51) Int. Cl.
*B65H 1/08* (2006.01)
*B65H 3/52* (2006.01)

(52) U.S. Cl. ..... 271/127; 271/121; 271/126; 271/147; 271/272

(58) Field of Classification Search ..... 271/273, 271/274, 121, 126, 127, 147
See application file for complete search history.

(56) References Cited

U.S. PATENT DOCUMENTS

| | | | | |
|---|---|---|---|---|
| 2,572,304 | A | 10/1951 | Beyer | |
| 2,644,685 | A | 7/1953 | Rockwell | |
| 3,411,768 | A | 11/1968 | Gatti | |
| 4,034,976 | A | 7/1977 | Lundblad | |
| 4,104,963 | A * | 8/1978 | Fortmann | 100/176 |
| 4,185,730 | A | 1/1980 | Roes et al. | |
| 4,309,601 | A | 1/1982 | Nally et al. | |
| 4,396,902 | A | 8/1983 | Warthan et al. | |
| 4,429,863 | A | 2/1984 | Itoh et al. | |
| 4,581,523 | A | 4/1986 | Okuno | |
| 4,607,835 | A | 8/1986 | Wilson et al. | |
| 4,743,974 | A | 5/1988 | Lockwood | |
| 4,753,337 | A | 6/1988 | Grosjean | |

(Continued)

FOREIGN PATENT DOCUMENTS

EP 1445930 A2 8/2004

(Continued)

OTHER PUBLICATIONS

"Check Scanner, (Digital Check's TellerScan-400 Product Announcement/Brief Article)," Magazine/journal, Computer Reseller News, May 4, 1998, p. 181(1), No. n787, publisher—CMP Publications, Inc.

(Continued)

*Primary Examiner*—Patrick H Mackey
*Assistant Examiner*—Luis Gonzalez
(74) *Attorney, Agent, or Firm*—Cook Alex Ltd.

(57) ABSTRACT

A document conveying apparatus comprises an inlet channel for receiving at least one document. A drive member is positioned for engagement with at least one document in the channel and is operable to move at least one document from the channel. An elongated member is associated with the channel and is movable to a first position towards the drive member which biases the at least one document towards the drive member. One portion of the elongated member is movable to a second position away from the drive member so as to allow insertion of at least one additional document into the inlet channel. Another portion of the elongated member is movable towards the drive member to bias the at least one document in the inlet channel into engagement with the drive member when the one portion of the elongated member is moved to the second position.

20 Claims, 4 Drawing Sheets

U.S. PATENT DOCUMENTS

| | | | | |
|---|---|---|---|---|
| 4,806,977 | A | 2/1989 | Mizutani et al. | |
| 4,871,160 | A | 10/1989 | Yoshino | |
| 4,896,871 | A | 1/1990 | Idenawa | |
| 4,908,719 | A | 3/1990 | Nonoyama | |
| 4,944,616 | A | 7/1990 | Watanabe et al. | |
| 4,944,620 | A | 7/1990 | Scozzafava et al. | |
| 4,958,825 | A | 9/1990 | Onomoto et al. | |
| 4,967,233 | A | 10/1990 | Buchar et al. | |
| 5,012,073 | A | 4/1991 | Hewitt et al. | |
| 5,046,713 | A | 9/1991 | Cargill | |
| 5,053,607 | A | 10/1991 | Carlson et al. | |
| 5,091,634 | A | 2/1992 | Finch et al. | |
| 5,119,213 | A | 6/1992 | Graves et al. | |
| 5,124,800 | A | 6/1992 | Hashimoto | |
| 5,125,047 | A | 6/1992 | Ito et al. | |
| 5,136,665 | A | 8/1992 | Inoue | |
| 5,162,846 | A | 11/1992 | Cahill | |
| 5,165,677 | A | 11/1992 | Shinada | |
| 5,276,536 | A | 1/1994 | Hokamura | |
| 5,280,368 | A | 1/1994 | Fullerton | |
| 5,288,064 | A | 2/1994 | Manabe et al. | |
| 5,367,581 | A | 11/1994 | Abel et al. | |
| 5,479,532 | A | 12/1995 | Abel et al. | |
| 5,534,682 | A | 7/1996 | Graef et al. | |
| 5,537,219 | A | 7/1996 | Morikawa et al. | |
| 5,602,650 | A | 2/1997 | Tamura et al. | |
| 5,603,493 | A * | 2/1997 | Kelly | 271/188 |
| 5,673,104 | A | 9/1997 | Rottner | |
| 5,698,835 | A | 12/1997 | Dvorkis et al. | |
| 5,748,780 | A | 5/1998 | Stolfo | |
| 5,751,431 | A | 5/1998 | Taka et al. | |
| 5,751,438 | A | 5/1998 | Murai et al. | |
| 5,760,926 | A | 6/1998 | Howard et al. | |
| 5,796,086 | A | 8/1998 | Gannon | |
| 5,807,457 | A | 9/1998 | Norman, Jr. et al. | |
| 5,808,647 | A * | 9/1998 | Kurata et al. | 347/104 |
| 5,865,544 | A | 2/1999 | Bellotto | |
| 5,875,374 | A | 2/1999 | Kikuchi et al. | |
| 5,959,279 | A | 9/1999 | Komatsu | |
| 5,961,230 | A | 10/1999 | Bellotto | |
| 5,978,626 | A | 11/1999 | Nagamine et al. | |
| 5,991,054 | A | 11/1999 | Hung et al. | |
| 6,089,773 | A * | 7/2000 | Bailey et al. | 400/642 |
| 6,129,270 | A | 10/2000 | Piazza | |
| 6,155,483 | A | 12/2000 | Chupka et al. | |
| 6,244,510 | B1 | 6/2001 | Ring et al. | |
| 6,259,808 | B1 | 7/2001 | Martinez et al. | |
| 6,290,129 | B2 | 9/2001 | Momose | |
| 6,308,886 | B1 | 10/2001 | Benson et al. | |
| 6,384,940 | B1 | 5/2002 | Kawai et al. | |
| 6,392,763 | B1 | 5/2002 | Nishinohara et al. | |
| 6,433,897 | B1 | 8/2002 | Wilcox et al. | |
| 6,473,519 | B1 | 10/2002 | Pidhirny et al. | |
| 6,481,624 | B1 | 11/2002 | Hayduchok | |
| 6,550,907 | B2 * | 4/2003 | Uchida | 347/104 |
| 6,598,870 | B2 | 7/2003 | Hanano | |
| 6,598,871 | B2 * | 7/2003 | Ono et al. | 271/180 |
| 6,761,425 | B2 * | 7/2004 | Kawaguchi et al. | 347/16 |
| 6,801,344 | B2 | 10/2004 | Morinaga et al. | |
| 6,966,554 | B2 | 11/2005 | Panini et al. | |
| 2001/0022661 | A1 | 9/2001 | Fujimoto et al. | |
| 2002/0036807 | A1 | 3/2002 | Terashima et al. | |
| 2002/0191830 | A1 | 12/2002 | Pidhirny et al. | |
| 2003/0019938 | A1 | 1/2003 | Byun et al. | |
| 2003/0075596 | A1 | 4/2003 | Koakutsu | |
| 2003/0095296 | A1 | 5/2003 | Terashima et al. | |
| 2004/0190016 | A1 | 9/2004 | Gatto et al. | |
| 2004/0251588 | A1 | 12/2004 | Panini et al. | |
| 2004/0257626 | A1 | 12/2004 | Panini et al. | |
| 2005/0041268 | A1 | 2/2005 | Panini | |
| 2005/0184455 | A1 * | 8/2005 | Youn | 271/274 |
| 2007/0102873 | A1 * | 5/2007 | Acton et al. | 271/273 |

FOREIGN PATENT DOCUMENTS

| | | |
|---|---|---|
| EP | 1453014 A2 | 9/2004 |
| EP | 1453015 A2 | 9/2004 |
| JP | 02-311077 | 12/1990 |
| JP | 03-003564 | 1/1991 |

OTHER PUBLICATIONS

A. Throne, "Remote Check Scanning Speeds Payment," journal, Transform Magazine, Jul. 2001, p. 67, vol. 10, No. 7, publisher—CMP Media, Inc., published in USA.

P. Lunt, "TellerScan 400: Check it Out," journal, Imaging & Document Solutions, Nov. 1999, p. 14, vol. 8, No. 11, publisher—Miller Freeman, published in USA.

"Canon U.S.A. Bundles Silver Bullet's Ranger Transport API with New, Compact CR-180 Check Transport," business wire (Pensacola, Florida), Newswire, Sep. 15, 2003, p. 5091.

"Canon CR-180 Check Transport Brings Industry-Leading Speed, Accuracy, Reliability to Desktop Check Scanning," business wire (Lake Success, New York), Newswire, Sep. 3, 2003, p. 5177.

"Desktop Check Scanning Breaks New Performance and Price Barriers," business wire (Boston, MA), Newswire, Oct. 19, 2000, p. 2549.

"Industry Briefs: VisionShape, Diamond Head Team," journal, Item Processing Report, Jul. 3, 1997, vol. 8, No. 13, publisher—Phillips Business Information, Inc.

"Conlux 5-Tube Changer, Validator Ensure Reliability," magazine/journal, Vending Times, Apr. 25, 2000, p. 20(1).

"Hamilton Manufacturing Corp. (Money Handling Equipment)," journal, Automatic Merchandiser, Jan. 1, 2003, p. 52(1), vol. 45, No. 1.

"Upgraded Validator (Supplier's Marketplace)," magazine/journal, Beverage Industry, Feb. 1, 2003, p. 74(1), vol. 94, No. 2.

"Canon Launches New DR-9280C and DR-6080 Scanners; New Generation of DR-Series Scanners Offer Total High-Volume Performance Solutions," business wire (Lake Success, New York), Newswire, Sep. 10, 2003, p. 5741.

"BancTec, Inc. Awarded Contract From Chevron U.S.A. Inc. for State-of-the-Art Transaction Processing and ARC Solution," PRNewswire (Long Beach, California), Jun. 9, 2003, p. DAM01809062003.

"Digital Check Introduces the TellerScan 400ES Designed for Branch, Remote and Distributed Capture Applications," business wire (Northfield, Illinois), Newswire, Apr. 7, 2003, p. 5415.

"Cashcode Co. Inc. Has Added a Stackerless Banknote Validator (Vending Market Watch News Final)," journal, Automatic Merchandiser, Feb. 1, 2003, p. 68(1), vol. 45, No. 2.

"CashCode to Supply Bill Balidators for BART Retrofit; Retains Advertising Firm for International Marketing . . . ", magazine/journal, Vending Times, Jun. 25, 1997, p. 63.

Digital Check's TellerScan 220, Unique Teller Window Scanner with Autofeeder, advertisement, Apr. 2003.

Digital Check's TellerScanner 200, Compact Countertop Scanner, advertisement, undated.

* cited by examiner

CONVEYING APPARATUS AND METHOD

BACKGROUND

This invention relates to an apparatus and method for conveying documents such as checks.

Apparatus and method for conveying documents such as checks may be useful in a wide variety of settings such as banking and financial institutions. For example, a document conveying device may convey a check or other document for scanning one or both sides thereof or for other purposes One type of an apparatus or method for conveying documents such as checks allows a check to be individually fed from an inlet area of the device. Some prior art devices employ a biasing mechanism to move a stack of checks disposed in the inlet area into engagement with a rotating roller, however, it may be difficult to insert additional checks between the roller and the biasing mechanism while the device is operating. Prior art devices typically do not allow for additional checks to be inserted into the device during operation without interfering with the biasing mechanism or the stack itself. The user may have to manually push against the biasing mechanism to create a gap sufficiently wide enough for the insertion of additional checks adjacent the checks already disposed in the inlet channel which may lead to tilting, misalignment or misfeeding of the checks with the roller or other portions of the device and/or other problems. Alternatively, prior art devices may also limit insertion of additional checks until the inlet area is empty of checks and the mechanism has stopped moving to avoid problems during device operation.

There is a continuing desire to provide an apparatus and method for conveying documents such as checks that provides reliable and continuous conveying of such documents or checks.

SUMMARY OF THE INVENTION

The present invention is generally directed to apparatus and method for conveying documents such as checks.

In accordance with one aspect of the present invention, a document conveying apparatus is provided which comprises an inlet channel for receiving at least one document therein. The apparatus also comprises a drive member positioned for engagement with at least one document in the inlet channel and operable to move at least one document from the inlet channel to a downstream location thereof. The apparatus further comprises an elongated member associated with the inlet channel and movable to a first position towards the drive member which biases the at least one document in the inlet channel into engagement with the drive member. One portion of the elongated member is movable to a second position away from the drive member so as to allow insertion of at least one additional document into the inlet channel. Another portion of the elongated member is movable towards the drive member to bias the at least one document in the inlet channel into engagement with the drive member when the one portion of the elongated member is moved to the second position.

In accordance with another aspect of the present invention, a document conveying apparatus is provided which comprises a housing, an inlet channel associated with the housing for receiving at least one document therein, an outlet channel associated with the housing and downstream of the inlet channel for receiving at least one document therein, and a scanner unit positioned between the inlet and outlet channels that is operable to scan at least one side of the document. The apparatus also includes a path positioned between the inlet and outlet channels to allow movement of a document from the inlet channel to the outlet channel. The apparatus further include a drive member positioned for engagement with at least one document that is received in the inlet channel and operable to move a document from the inlet channel to a downstream location thereof An elongated member is associated with the inlet channel and movable to a first position towards the drive member which biases the at least one document in the inlet channel into engagement with the drive member. One portion of the elongated member is movable to a second position away from the drive member so as to allow insertion of at least one additional document into the inlet channel. Another portion of the elongated member is movable towards the drive member to bias the at least one document in the inlet channel into engagement with the drive member when the one portion of the elongated member is moved to the second position.

In accordance with a further aspect of the present invention, a method for conveying documents is provided. The method includes providing an apparatus including an inlet channel for receiving at least one document therein, a drive member positioned for engagement with at least one document in the inlet channel and operable to move a document from the inlet channel to a downstream location thereof, and an elongated member associated with the inlet channel. The method also includes inserting at least one document into the inlet channel and moving the elongated member towards the drive member to a first position which biases the at least one document in the inlet channel towards the drive member. The method further includes, during operation, moving at least a portion of the elongated member to a second position to allow insertion of at least one additional document into the inlet channel, while another portion of the elongated member engages the at least one document disposed in the inlet channel with the drive member.

DESCRIPTION OF THE PREFERRED EMBODIMENTS

Figure 1:
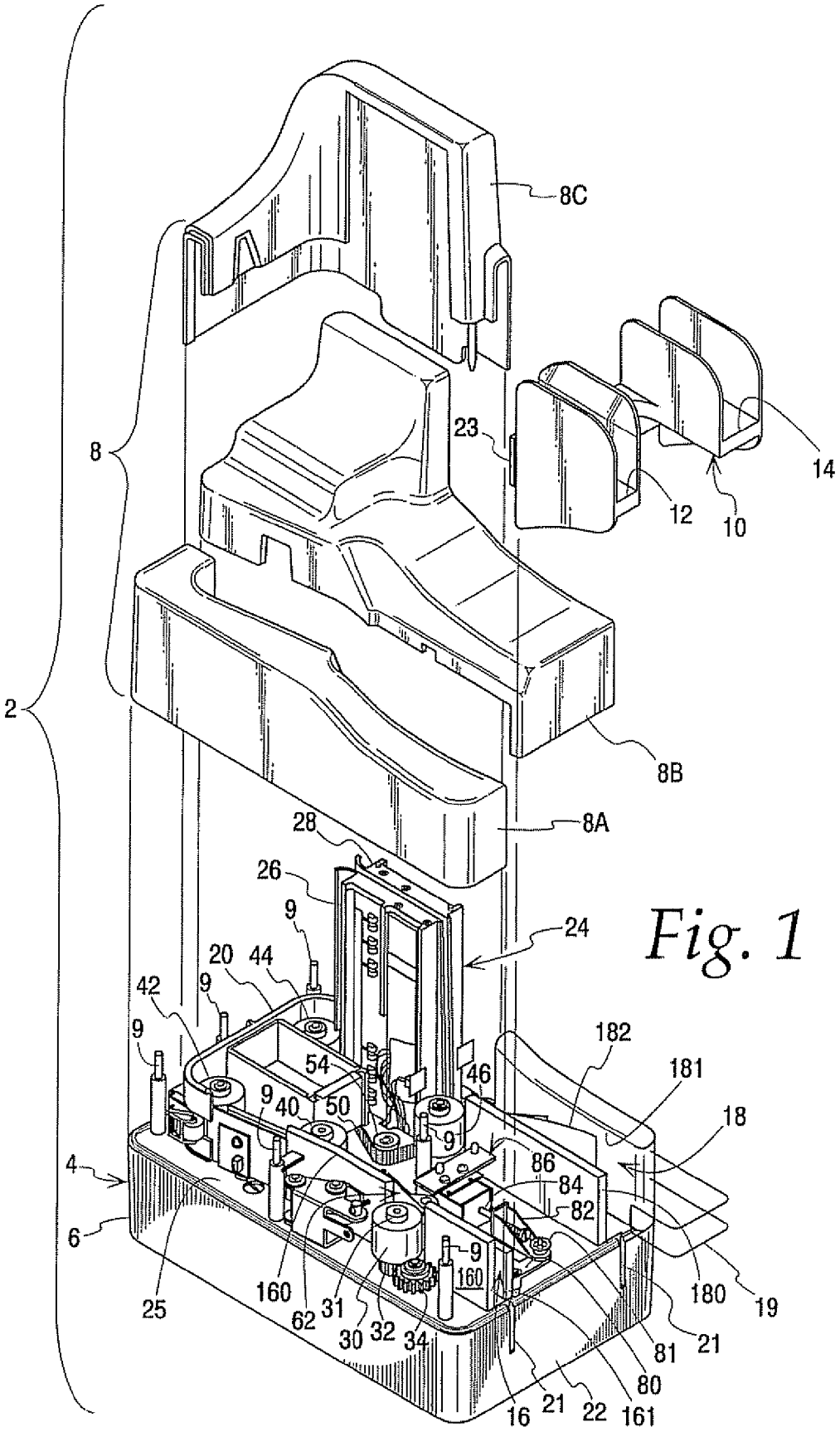
FIG. 1 is an exploded top perspective view of an apparatus embodying the present invention with upper portions of a housing shown spaced from a lower portion of the housing to show the interior of the apparatus.

In accordance with one embodiment of the present invention, FIG. 1 illustrates an apparatus, generally indicated at 2, for conveying at least one document or a plurality of documents such as checks through the apparatus 2. The apparatus 2 may include a housing generally indicated at 4 which may comprise a lower portion 6 and an upper portion 8. In FIG. 1, the upper portion 8 of the housing 4 includes an assembly of three sections 8A, 8B and 8C which fit together such as 8A and 8C or which fit together with a sufficient gap therebetween such as BA and 8B and/or 8B and SC to allow documents to pass through the apparatus. The upper portions 8A, 8B, 8C may be positioned on the apparatus and various projections 9 may assist in placement or alignment of the upper portions on the apparatus 2. Other modifications and variations from the design and configuration of the housing shown in FIG. 1 are also possible including that the housing may be comprised of any number of sections which fit together and/or which fit together with a sufficient gap to allow the documents to pass through the apparatus.

In FIG. 1, the apparatus 2 includes a front portion, generally indicated at 10, which includes two channel extensions 12, 14. The front portion may be removable from the remaining portion of the apparatus, as described in further detail below. In FIG. 1, the apparatus 2 also includes an inlet channel 16 and outlet channel 18. The channel extensions 12, 14 are generally, and respectively, aligned with inlet and outlet channels, generally indicated at 16, 18. The channel extension 12 may be disposed upstream of the inlet channel 16 and the channel extension 14 may be disposed downstream of the outlet channel 18. In FIG. 1, a document guide 19 may be associated with the outlet channel 18 and may extend around outer edges of the downstream channel 14 so as to contain and maintain collation as documents stack in the outlet channel 18.

Figure 2:
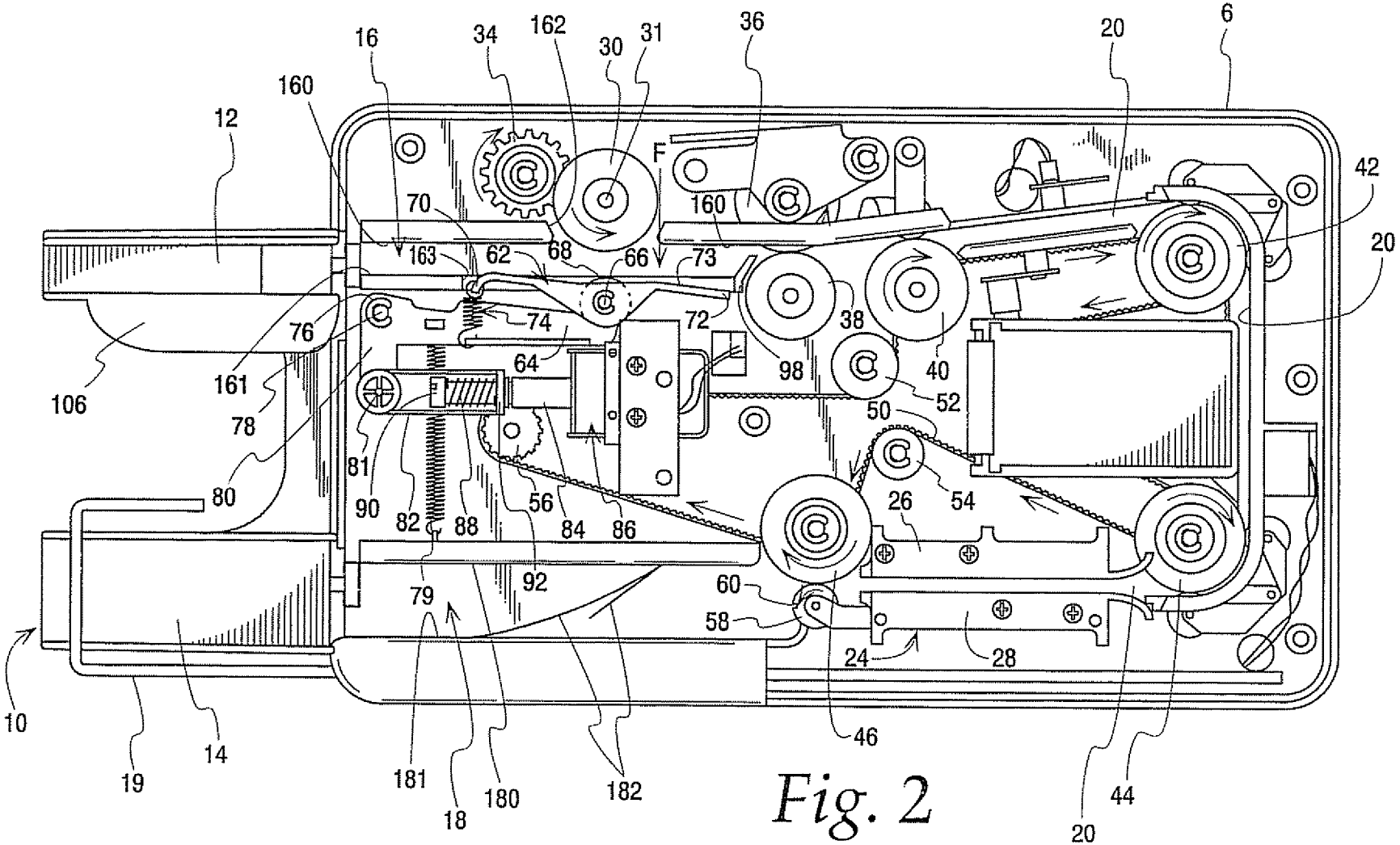
FIG. 2 is a top view of the apparatus of FIG. 1 with upper portions of the housing removed.

In FIGS. 1-2, the inlet channel 16 preferably includes spaced apart opposed walls 160, 161 for receiving at least one document such as a check therebetween. The left wall 160 may include a gap or shortened wall portion 162 and the right wall 161 may include a gap or shortened wall portion 163 to permit one or more structures to be associated with the inlet channel as described in further detail below. The outlet channel 18 also preferably includes spaced apart opposed walls 180, 181 for receiving at least one document such as a check therebetween. In FIG. 2, one or more curved flaps 182 may be positioned in the outlet channel. The flaps 182 may have a convex curve facing the right wall 181 to assist positioning of the documents or checks against the right wall 181 during operation. Other structures variations and modifications are also possible.

A document path 20 extends between the inlet and outlet channels 16, 18. In FIG. 1, the path 20 generally defines a U-shape between the inlet and outlet channels 16, 18, with the inlet and outlet channels 16, 18 located at the front of the apparatus 2, although other shapes and/or locations of the path and channels are also possible.

In FIG. 1, a front surface 22 includes one or more slots 21. The front portion 10 may be removably attachable to the front surface 22. A rear surface of the front portion 10 may include one or more projections 23 (only one being shown in FIG. 1) which are adapted to be received by the slots 21 of the front surface 22 in a slidable relationship. The projections 23 (also shown in FIG. 6) may have any shape such as, and not limited to, a T-shape or other suitable shape for engaging the slots 21 formed in the front surface 22, as shown in FIG. 1. Although the front surface 22 is shown with slots and the front portion 10 is shown with projections, other connecting structures are also possible and/or such structures may be reversed so that projections extend from the front surface 22 and engage slots formed in the front portion 10. Although a pair of structures is shown relative to the front surface 22, any number is possible. For purposes of this description, it is contemplated that the terms "front" and "rear" are not intended to limit the present invention, that other terms may be used and/or that such terms may be used interchangeably to refer to different portions of the apparatus.

In FIG. 1, the lower portion 6 of the housing generally includes at least one motor (not shown) which is located at least in part within the lower portion 6 or beneath a horizontal surface 25. The motor may be powered by a source of energy or power such as by an electrical connection, battery and/or the like. Activation of the motor may be controlled on the apparatus such as a switch actuator and/or activation may be remotely controlled such as by a computer or other like device, as desired by the application and/or the user.

In FIG. 1, the apparatus 2 may further include a scanning unit, generally indicated at 24, which may include two parallel scanners 26, 28 for scanning opposite sides or faces of a document such as a check. The scanning unit 24 is preferably electronically connected to a source for storing the information that is scanned from the document which may be a computer or other like device which may be located at a remote location from the apparatus 2. At least one of the scanners 26, 28 may be pivotable to allow access between the scanners 26, 28 for maintenance and cleaning of the scanners 26, 28. The scanning unit 24 may provide for optical image scanning and/or may permit the information on the document to be read by optical character recognition (OCR) using a suitable devices software, or other scanning methods. As part of the scanning unit 24 or a separate structure there from, there may also be a magnetic reading unit that is preferably disposed and operable to capture the magnetic ink character recognition (MICR) code line that is disposed on the front face of the check. Other modifications and variations are also possible In FIGS. 1-2, a drive member 30 rotates in a counterclockwise direction, as indicated by the arrow in FIG. 2. The drive member 30 preferably is position for engagement with at least one document such as a check in the inlet channel 16 when such document is disposed on the left hand side of the channel 16 in FIG. 2. The drive member 30 is operable to move at least one document such as a check from the inlet channel 16 to a downstream location thereof upon rotation movement of the drive member 30 when a document is positioned adjacent thereto In FIG. 1, the drive member 30 rotates about a central shaft 31 during operation of the apparatus 2. A gear mechanism 32 may be associated with the bottom of the drive member shaft 31, as shown in FIG. 1, and may be driven by engagement with teeth of an associated drive gear 34, as also shown in FIGS. 1-2. In FIG. 2, the drive gear 34 rotates in a clockwise direction for driving the drive member 30 and may be actuated upon activation of the motor of the apparatus 2.

Figure 3:
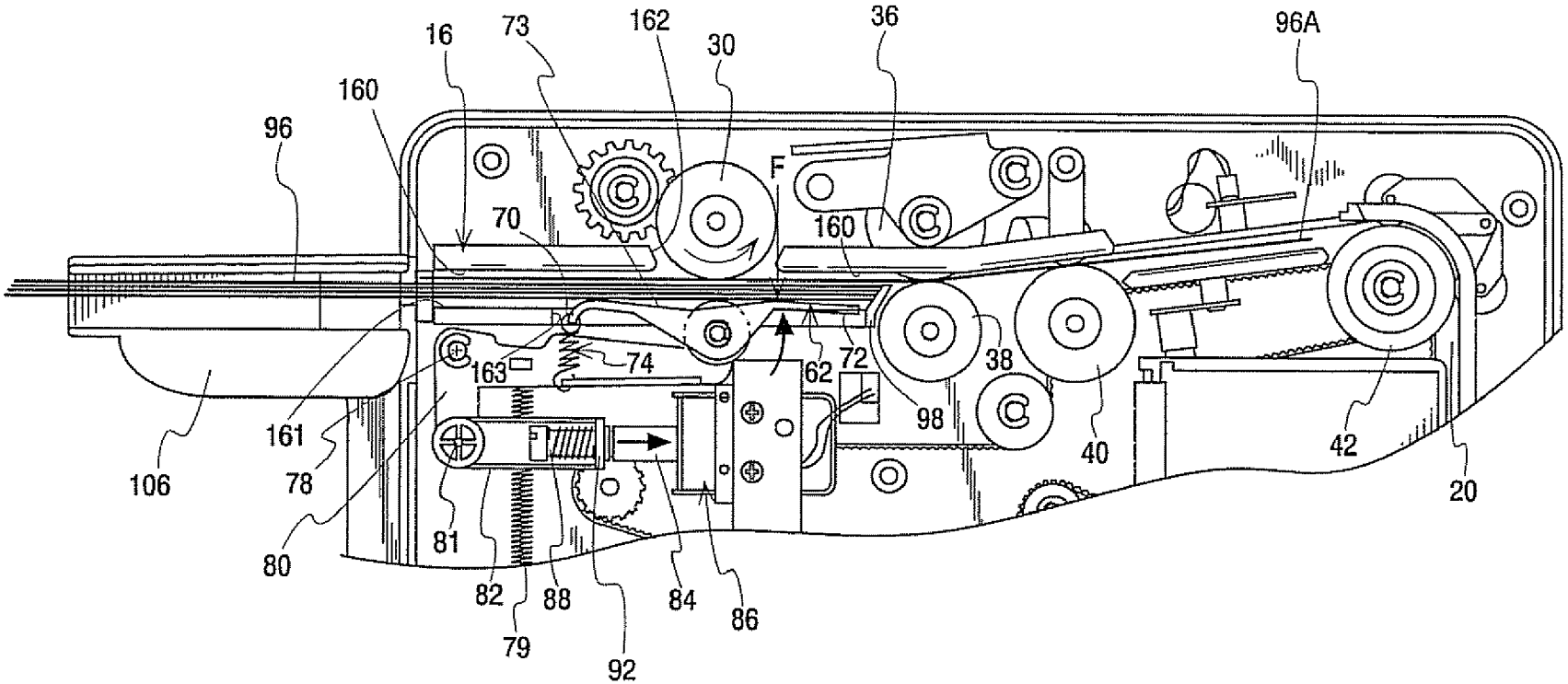
FIG. 3 is a partial top view of the apparatus of FIG. 2 showing an inlet channel of the present invention and further showing portions of the apparatus, including an elongated member, being moved relative to the positions shown in FIG. 2 to depict the apparatus during operation.

Various structures may also be located along the path 20 or may be associated with structures for conveying a document or check along the path 20 In FIG. 2, a drive roller 36 preferably rotates in a counterclockwise direction for engaging a document or check that has been advanced in a downstream direction from the drive member 30. An opposing roller 38 is preferably located across the path 20 from the drive roller 36. The drive roller 36 and opposing roller 38 are preferably engaged by a sufficient amount to preferably allow about one individual document such as a check to be advanced along the path 20 therebetween and to avoid two documents from being advanced at the same time. The opposing roller 38 is preferably stationary so as to stop the downstream progress of a second document or check that is located to the right of the first document (such as shown in FIG. 3) and prevent such second document from being simultaneously advanced with the first document. The opposing roller 38 may be made of a material having sufficient friction which may be helpful to avoid two or more documents or checks to be advanced by the drive roller 36 at the same time. The path 20 may further include one or more additional rollers 40, 42, 44, 46, one or more conveying belts 50, one or more guides 52, 54, one or more pulleys 56, and/or other like structures to facilitate movement of the document or check along the path 20 for conveying to the outlet channel 18.

In FIG. 2, the apparatus 2 may also include a slotted roller 58 having a vertical slot 60 to help positioning of the document or check in the outlet channel 18. The slotted roller 58 is generally located opposite the roller 46 and both are positioned upstream of the outlet channel 18. The slotted roller 58 rotates in a counterclockwise direction and the roller 46 rotates in a clockwise direction for conveying a document or check into the outlet channel 18. During operation, rotation of the slotted roller 58 may receive and/or engage the trailing edge of the document or check that is being conveyed into the outlet channel 18. The document or check edge rotates counterclockwise with the slotted roller 58 so as to move the document or check towards the right hand side of the channel 18 in FIG. 2. This may be helpful to dispose the check or a stack of checks along the right hand side wall of the outlet channel 18. This may further be helpful to prevent the check or checks in the outlet channel 18 from interleaving with other checks that are being conveyed by the rollers 46 into the outlet channel 18. Further rotational movement of the slotted roller 58 will cause the slot 60 to become disengaged from the check.

In FIG. 2, an elongated member, generally indicated at 62, may be associated with the inlet channel 16. The elongated member 62 is preferably movable relative to the inlet channel 16. In FIG. 2, the elongated member 62 may be mounted to a movable arm 64 which permits movement of the elongated member 62 in the channel 16 towards or away from the drive member 30. The elongated member preferably biases documents such as checks into engagement with the drive member 30 when such documents are positioned in the inlet channel 16

In FIG. 2, the elongated member may be pivotably mounted to the movable arm 64 at a pivot 66 so as to permit pivotal movement of the elongated member relative to the movable arm 64. A roller 68 may be mounted for rotation about the pivot 66, although other locations are also possible. As shown in FIG. 2, the elongated member 62 has an upstream end 70 and a downstream end 72. In FIG. 2, the upstream end 70 may have a curve or other shape which may assist engagement of the upstream end 70 when pivotal movement of the elongated member 62 at the pivot 66 is desired. The elongated member 62 also includes a surface 73 which is disposed on each side of the roller 68 which surface, or portions thereof, may engage documents such as checks disposed in the inlet channel 16. The upstream end 70 is preferably connected by a spring 74 to the movable arm 64 so that the spring 74 causes the upstream end 70 of the elongated member 62 to be normally biased in the position shown in FIG. 2, which position may be generally parallel to the right wall 161 when the apparatus is not in operation.

In FIG. 2, the movable arm 64 extends from the pivot 66 to an end 76 that is preferably pivotably attached at a pivot 78 to the horizontal surface 25. A spring 79 normally biases the movable arm 64 in the position shown in FIG. 2. One end of the spring 79 may be attached to the movable arm 64 in the vicinity of the end 76, although other positions are also possible. In FIG. 2, an extension 80 of the movable arm 64 extends from the pivot 78 towards a frame 82 which frame is, in turn, pivotably attached to the extension 80 at a pivot pin 81, which pin 81 is free of attachment to the horizontal surface 25.

The apparatus may include a solenoid, generally indicated at 86, that includes an associated plunger 84. The plunger 84, or a portion thereof, is preferably linearly extensible from the solenoid 86 depending on the extent of activation of the solenoid 86. The frame 82 is preferably slidably attached to the plunger 84 so as to permit extension or contraction of the plunger as the solenoid is activated or deactivated.

The solenoid 86 is preferably electrically connected to a source of energy which allows for activation of the solenoid which may be activated, for example, by an actuator located on the apparatus 2 such as a switch or by a remote actuator such as a computer or other like device. In FIG. 2, a spring 88 normally biases the plunger 84 of the solenoid 86 to the extended position shown in FIG. 2 when the solenoid is not activated. The ends of the spring 88 are positioned between the head of shoulder screw 90 and a ledge 92 of the frame 82. Other connecting arrangements are also possible and are not limited to the arrangement shown in the drawings.

Activation of the solenoid 86 causes linear movement of the plunger 84 from an extended position shown in FIG. 2 to a contracted or activated position such as for example shown in FIG. 3, with the direction of movement of the plunger being indicated by the arrow in FIG. 3. In FIG. 3, linear movement of the plunger 84 into the solenoid causes compression of the spring 8B between the head of shoulder screw 90 and the ledge 92 of the frame 82, and, also forces the frame 82 in an inward direction, as shown by the arrow in FIG. 3. The extension 80 pivots relative to the frame 82 at the pivot pin 81 which also moves inwardly. The extension 80 moves inward with the action of pivot pin 81, and this movement of the extension 80 causes relative pivotable movement of the movable arm 64 at the pivot 78 in a counterclockwise direction creating tension to the spring 79. Movement of the movable arm 64, in turn, moves the elongated member 62 in a direction towards the drive member 30, as indicated by the arrow in FIG. 3.

In FIG. 3, the activation of the solenoid is preferably activated so as to provide a sufficient biasing force such that the documents or checks in the inlet channel 16 are biased against the drive member 30. It is contemplated that the extent of compression of the spring 88 may vary so as to apply a sufficient amount of force that causes the leading document or check in the inlet channel 16 into engagement with the drive member 30 throughout operation of the apparatus. It is contemplated that the compression of the spring 88 may adjust such force throughout the operation of the apparatus as the number of documents or checks in the inlet channel 16 varies.

In FIG. 3, a plurality of documents such as checks 96 are positioned in the inlet channel 16 with the elongated member 62 moved against the checks 96 and so that the leftmost check 96A is in engagement with the drive member 30. Preferably, the solenoid 86 is actuated so that the elongated member 62 provides sufficient force for biasing the checks disposed in the inlet channel 16 against the drive member 30. In FIG. 3, at least a portion of the surface 73 of the elongated member 62 may push against the documents or checks as the elongated member 62 moves the documents or checks 96 against the drive member 30. Activation of the device also causes the drive member 30 to rotate in a counterclockwise direction so as to move the leading document or check 96A in a downstream direction and into engagement with the other drive rollers 36, 40 as it follows the path 20. A barrier 98 assists in preventing too many trailing checks from being simultaneously conveyed with the leading check 96A. The stationary roller 38 also may assist in preventing any trailing documents or checks immediately adjacent the leading document or check from being moved downstream of the barrier 98. Other structures or modifications are also possible and are not limited to the embodiment shown.

Figures 4, 5, 6:
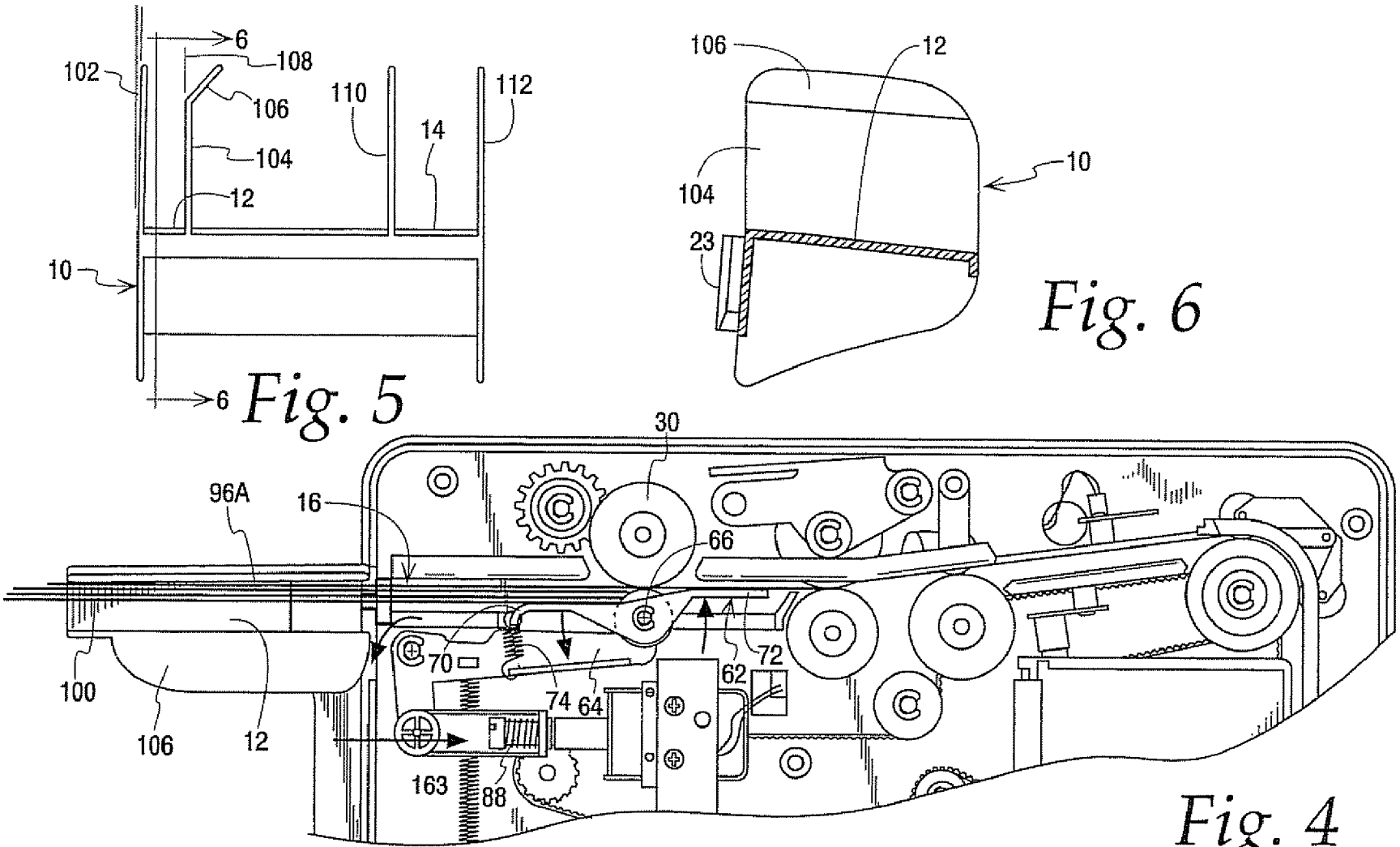
FIG. 4 is a partial top view of the apparatus shown in FIG. 2 showing the elongated member being moved relative to the position shown in FIG. 3 to allow insertion of additional documents into the inlet channel during operation of the apparatus.
FIG. 5 is a front end view of a front portion of the apparatus shown in FIGS. 1 and 2, with other portions of the apparatus removed.
FIG. 6 is a cross-sectional view of the front portion of then apparatus shown in FIG. 5 along plane 6-6.

In FIG. 4, the present invention provides for additional checks to be inserted into the inlet channel 16 during operation of the apparatus. In FIG. 4, at least one additional check 100 may be inserted into the inlet channel 16 behind the leading document or check 96A or behind one or more leading checks 96 already disposed in the inlet channel 16. Such additional checks 100 may be inserted between the check 96A (in FIG. 4) or checks 96 (in FIG. 3) and the upstream end 70 of the elongated member 62. The curved shaped of the upstream end 70 may facilitate the insertion of such additional checks 100. During insertion, the upstream end 70 is allowed to pivot away from the drive member 30 about the pivot 66 and the spring 74 is compressed.

The elongated member 62 pivots in a counterclockwise direction relative to the pivot 66, as indicated by the arrows in FIG. 4. The upstream end 70 of the elongated member 62 initially moves away from the drive member 30 to allow a gap sufficient to allow insertion of the addition checks 100. Correspondingly, the downstream end 72 of the elongated member 62 pivots towards the drive member 30 thereby biasing the documents or checks 96A, 96 already disposed in the inlet channel 16 into engagement with the drive member 30 to allow continued operation of the apparatus 2. Continuing to insert additional checks 100 past this point causes additional compression of spring 88 thereby allowing the movable arm 64 to adjust to the additional stack thickness. This process may be continuously repeated throughout operation of the apparatus to allow multiple additional stacks of checks to be inserted as desired by the application and/or the user without interruption of the apparatus operation. In this manner, the scanner may be kept operating continuously without regard to the limited fixed capacity of the inlet channel.

The present invention may also include other features that may be helpful to allow insertion of the additional checks into the apparatus 2. For example, as shown in FIG. 5, the upstream and downstream channel extensions 12, 14 of the front portion 10 respectively include left walls 102, 110 and right walls 104, 112 which are generally opposed to one another. The right wall 104 of the upstream channel extension 12 includes an upper portion 106 which is preferably acutely angled with respect to a vertical plane 108. In FIG. 5, the angled portion 106 of the right wall 104 may be helpful to assist the insertion of additional checks 100 during operation. By way of example and not limitation, the angled upper portion 106 at the top of the channel extension 12 may assist the placement of additional documents or checks 100 to the right of the existing checks in the inlet channel 16 (as shown in FIG. 3) without interfering with the existing documents or checks that are disposed in the inlet channel 16 Other variations and modifications are also possible and are not limited to the embodiments shown.

The benefits of the present invention may be helpful to provide an apparatus that biases documents such as checks into engagement for conveying such documents through the apparatus while simultaneously providing for additional documents or checks to be inserted into the apparatus during operation of the apparatus. The benefits of the present invention may also provide for essentially continuous or non-interrupted operation which improves system throughput, and reduces the risk of misaligned or misfed documents. Documents such as checks may be inserted into the apparatus and positioned adjacent to documents that are already disposed in the inlet channel without interfering with the operation of the apparatus. Documents that are already disposed in the inlet channel are biased against the drive member by one portion of the elongated member while another portion of the elongated member provides a sufficient gap for insertion of the additional documents into the apparatus. Although a preferred embodiment of the device may be shown, the present invention is not limited to such structures and other structures may be employed for carrying out the present invention.

As can be seen from the above description, the present invention has several different aspects, which are not limited to the specific structure shown in the attached drawings Variations of these concepts or structures may be embodied in other structures for carrying out conveying of documents such as checks or other applications without departing from the present invention as set forth in the appended claims.

The invention claimed is:

1. A document conveying apparatus comprising:

an inlet channel for receiving a plurality of documents therein;

a drive member positioned for engagement with one of the plurality of documents in the inlet channel and operable to move one document from the inlet channel to a downstream location thereof; and an elongated member disposed in the inlet channel and movable to a first position towards the drive member which biases one of the plurality of documents in the inlet channel towards the drive member, one portion of said elongated member being movable to a second position away from the drive member for insertion of at least one additional document into the inlet channel, and another portion of said elongated member being movable towards the drive member to bias one of the plurality of documents and the at least one additional document in the inlet channel into engagement with the drive member when said one portion of said elongated member is moved to the second position.

2. The apparatus of claim 1 wherein the elongated member is pivotable.

3. The apparatus of claim 2 wherein the elongated member pivots along an axis disposed along its length.

4. The apparatus of claim 1 wherein the elongated member includes a rotatable member along its length for engagement with one of the plurality of documents.

5. The apparatus of claim 1 wherein the drive member is rotatable.

6. The apparatus of claim 1 wherein the elongated member is normally biased during operation to said first position by a resilient member.

7. The apparatus of claim 1 wherein said elongated member is movable to a third position in which the elongated member is spaced from the drive member when the apparatus is not operating.

8. The apparatus of claim 7 further comprising an actuating member operable to move the elongated member between a selected one of the first, second or third positions to at least another of said positions.

9. The apparatus of claim 8 wherein the actuating member includes an electromagnetic member.

10. The apparatus of claim 8 wherein the actuating member includes a solenoid.

11. The apparatus of claim 1 wherein the inlet channel includes two opposed vertical walls for receiving the plurality of documents therebetween in a vertically disposed orientation.

12. The apparatus of claim 11 wherein at least a portion of one wall is angled from a vertical plane.

13. A document conveying apparatus comprising:

a housing;

an inlet channel associated with the housing for receiving a plurality of documents therein;

an outlet channel associated with the housing and downstream of the inlet channel for receiving at least one document therein;

a scanner unit positioned between the inlet and outlet channels operable to scan at least one side of at least one document;

a path positioned between the inlet and outlet channels to allow movement of one document at a time from the inlet channel to the outlet channel;

a drive member positioned for engagement with at one of the plurality of documents that are disposed in the inlet channel and operable to move a document from the inlet channel to a downstream location thereof; and an elongated member disposed in the inlet channel and movable to a first position towards the drive member which biases one of the plurality of documents in the inlet channel towards the drive member, one portion of said elongated member being movable to a second position away from the drive member for insertion of at least one additional document into the inlet channel, and another portion of said elongated member being movable towards the drive member to bias one of the plurality of documents and the at least one additional document in the inlet channel into engagement with the drive member when said one portion of said elongated member is moved to the second position.

14. The apparatus of claim 13 wherein the elongated member is pivotable.

15. The apparatus of claim 14 wherein the elongated member pivots along an axis disposed along its length.

16. The apparatus of claim 13 wherein the elongated member includes a rotatable member along its length for engagement with one of the plurality of documents.

17. The apparatus of claim 13 wherein the drive member is rotatable.

18. The apparatus of claim 13 wherein the elongated member is normally biased during operation to said first position by a resilient member.

19. A method for conveying documents including:

providing an apparatus including an inlet channel for receiving at least one document therein, a drive member positioned for engagement with at least one document in the inlet channel and operable to move a document from the inlet channel to a downstream location thereof, and an elongated member disposed in the inlet channel;

inserting a plurality of documents into the inlet channel;

moving the elongated member towards the drive member to a first position which biases one of the plurality of documents in the inlet channel towards the drive member; and during operation, moving at least a portion of the elongated member to a second position to allow insertion of at least one additional document into the inlet channel while another portion of the elongated member engages one of the plurality of documents and the at least one additional document disposed in the inlet channel with the drive member.

20. The method of claim 19 wherein moving at least a portion of said elongated member to a second position includes moving one portion of said elongated member away from the drive member so as to provide a gap sufficient for insertion of at least one additional document into the inlet channel, and another portion of said elongated member is movable towards the drive member to bias one of the plurality of documents and the at least one additional document in the inlet channel into engagement with the drive member when said one portion is moved to the second position.

* * * * *